US008579294B2

(12) United States Patent
Wright et al.

(10) Patent No.: US 8,579,294 B2
(45) Date of Patent: Nov. 12, 2013

(54) EMERGENCY STOPPING SYSTEM FOR TRACK MOUNTED MOVABLE BULLET TARGETS AND TARGET TROLLEYS

(75) Inventors: Tom Wright, Highland, UT (US); Ernest John, American Fork, UT (US); David Bassett, Provo, UT (US); Dustin Harding, Orem, UT (US); Mike Long, Fountain Green, UT (US)

(73) Assignee: Action Target Inc., Provo, UT (US)

( * ) Notice: Subject to any disclaimer, the term of this patent is extended or adjusted under 35 U.S.C. 154(b) by 139 days.

(21) Appl. No.: 13/332,321

(22) Filed: Dec. 20, 2011

(65) Prior Publication Data

US 2012/0261882 A1 Oct. 18, 2012

Related U.S. Application Data

(60) Provisional application No. 61/425,708, filed on Dec. 21, 2010.

(51) Int. Cl.
*F41J 9/02* (2006.01)

(52) U.S. Cl.
USPC ..... 273/359; 273/406; 104/249

(58) Field of Classification Search
USPC ..... 273/359, 366–370, 406; 104/249, 251, 104/254, 255, 239
See application file for complete search history.

(56) References Cited

U.S. PATENT DOCUMENTS

| | | | | |
|---|---|---|---|---|
| 429,942 | A | | 6/1890 | McBride |
| 570,820 | A | | 11/1896 | Scratton |
| 631,175 | A | | 8/1899 | Parnall |
| 683,370 | A | * | 9/1901 | Acklin ..... 104/249 |
| 683,371 | A | * | 9/1901 | Acklin ..... 104/239 |
| 840,610 | A | | 1/1907 | Easdale |
| 879,670 | A | | 2/1908 | Petry |
| 937,733 | A | | 10/1909 | Worrell |
| 950,101 | A | | 2/1910 | Green |
| 960,085 | A | | 5/1910 | Giles |
| 960,892 | A | | 6/1910 | Gates |
| 1,207,456 | A | | 12/1916 | Whelan |
| 1,348,283 | A | | 8/1920 | Koehl |
| 1,424,632 | A | | 8/1922 | Fenton |
| 1,540,802 | A | | 6/1925 | Ordway |
| 1,543,605 | A | | 6/1925 | Gavard |
| 1,559,171 | A | | 10/1925 | Knowles |
| 1,657,931 | A | | 7/1926 | Krantz |
| 1,640,954 | A | | 8/1927 | Mach |
| 1,738,874 | A | | 12/1929 | Domingo |

(Continued)

FOREIGN PATENT DOCUMENTS

| | | |
|---|---|---|
| CA | 2100631 | 2/1994 |
| GB | 2136932 | 9/1984 |
| GB | 2 187 270 | 9/1987 |

OTHER PUBLICATIONS

Caswell International Corp., Product Literature, Copyright 2002.

(Continued)

*Primary Examiner* — Mark Graham
(74) *Attorney, Agent, or Firm* — Bateman IP

(57) ABSTRACT

An emergency stopping system for track mounted movable targets used divergent cables to stop a target trolley which has not been otherwise stopped before coming to the end of a track. As the trolley passes over the diverging cables, the cables are forced together, causing the trolley to dissipate kinetic energy.

21 Claims, 12 Drawing Sheets

(56) References Cited

U.S. PATENT DOCUMENTS 1,831,289 A 11/1931 Dally
2,048,155 A 1/1935 Armantrout
2,008,359 A 7/1935 Lamb
2,039,552 A 5/1936 Reynolds
2,085,933 A 7/1937 Vaughan
2,104,171 A 1/1938 Schwerin
2,179,471 A 11/1939 Lee
2,284,510 A 5/1942 Cates
2,290,297 A 7/1942 Smith
2,344,829 A 3/1944 McAvoy
2,372,111 A 3/1945 Norberg
2,538,118 A 6/1949 Miller
2,494,210 A 1/1950 Robinson
2,535,280 A 12/1950 Gartrell
2,586,958 A 2/1952 Keller
2,587,042 A 2/1952 Haiselup
2,613,934 A 10/1952 Tabler
2,706,634 A 4/1955 Van Valkenburg
2,809,836 A 10/1957 Musser
2,819,903 A 1/1958 Saunders
2,838,309 A 6/1958 Merz et al.
2,905,469 A 9/1959 Taylor
3,014,725 A * 12/1961 Lewis ..... 273/406
3,032,808 A 5/1962 Fleming
3,064,976 A 11/1962 Kuhn
3,087,701 A 4/1963 Wallace
3,103,362 A 9/1963 Elofson
3,113,773 A 12/1963 Ripepe
3,140,874 A 7/1964 Jensen et al.
3,324,832 A * 6/1967 McCain ..... 119/839
3,348,843 A 10/1967 Stanley
3,363,900 A 1/1968 Cadle
3,385,405 A 5/1968 Cullen
3,392,980 A 7/1968 Ortega
3,422,538 A 1/1969 Panissidi
3,471,153 A 10/1969 Baumler
3,510,133 A 5/1970 Gretzky
3,515,388 A 6/1970 Zachmeier
3,540,729 A 11/1970 Rahberger
3,601,353 A 8/1971 Dale
3,614,102 A 10/1971 Nikoden, Sr.
3,802,098 A 4/1974 Sampson et al.
3,914,879 A 10/1975 Taylor, III
3,992,007 A 11/1976 Seeman
4,072,313 A 2/1978 Murso et al.
4,076,247 A 2/1978 Kim et al.
4,084,299 A 4/1978 Noda
4,086,711 A 5/1978 Gammarino et al.
4,177,835 A 12/1979 Paley
4,198,049 A * 4/1980 Kurita ..... 273/119 A
4,205,847 A 6/1980 Steiger et al.
4,228,569 A 10/1980 Snyder
4,232,867 A 11/1980 Tate, Sr.
4,288,080 A 9/1981 Laporte et al.
4,294,452 A 10/1981 Schlotter et al.
4,340,370 A 7/1982 Marshall et al.
4,361,330 A 11/1982 Scharer
4,395,045 A 7/1983 Baer
4,440,399 A 4/1984 Smith
4,501,427 A 2/1985 Payne
4,506,416 A 3/1985 Ohminato et al.
4,540,182 A 9/1985 Clement
4,546,984 A 10/1985 Towle et al.
4,614,345 A 9/1986 Doughty
4,657,261 A 4/1987 Saunders
4,691,925 A 9/1987 Scholem
4,706,963 A 11/1987 Geuss
4,726,593 A 2/1988 Wade
4,739,996 A 4/1988 Vedder
4,743,032 A 5/1988 Summers et al.
4,807,888 A 2/1989 Pidde
4,844,476 A 7/1989 Becker
4,890,847 A 1/1990 Cartee et al.
4,898,391 A 2/1990 Kelly et al.
4,911,453 A 3/1990 Essex et al.
4,913,389 A 4/1990 McCracken
4,979,752 A 12/1990 Fosseen
5,054,723 A 10/1991 Arnold
5,145,133 A 9/1992 France
5,163,689 A 11/1992 Bateman
5,213,336 A 5/1993 Bateman
5,232,227 A 8/1993 Bateman
5,240,258 A 8/1993 Bateman
5,242,172 A * 9/1993 Bateman ..... 273/369
5,255,629 A * 10/1993 Paterson ..... 119/839
5,263,721 A 11/1993 Lowrance
5,277,432 A 1/1994 Bateman
5,316,479 A 5/1994 Wong et al.
5,324,043 A 6/1994 Estrella
5,346,226 A 9/1994 Block
5,350,180 A 9/1994 Acock
5,352,170 A 10/1994 Condo et al.
5,361,455 A 11/1994 Kiefer
5,400,692 A 3/1995 Bateman
5,433,451 A 7/1995 De Vries
5,535,662 A 7/1996 Bateman
5,568,927 A * 10/1996 Badorrek ..... 273/366
5,598,996 A 2/1997 Rath
5,605,335 A 2/1997 Simpson
5,618,044 A 4/1997 Bateman
5,621,950 A 4/1997 White
5,636,995 A 6/1997 Sharpe, III et al.
5,641,288 A 6/1997 Zaenglein, Jr.
5,648,794 A 7/1997 Jelsma et al.
5,649,706 A 7/1997 Treat, Jr. et al.
5,676,378 A 10/1997 West
5,695,196 A 12/1997 Yanosky
5,765,832 A 6/1998 Huff
5,802,460 A 9/1998 Parvulescu et al.
5,811,718 A 9/1998 Bateman
5,822,936 A 10/1998 Bateman
5,829,753 A 11/1998 Wiser
5,848,791 A * 12/1998 Beyer et al. ..... 273/359
5,865,439 A 2/1999 Marcuson
5,868,396 A * 2/1999 Theissen ..... 273/406
5,906,552 A 5/1999 Padilla
5,907,930 A 6/1999 Ricco
5,934,678 A 8/1999 Theissen et al.
5,947,477 A 9/1999 Turnipseed
5,950,283 A 9/1999 Sato
5,951,016 A 9/1999 Bateman
5,963,624 A 10/1999 Pope
5,967,523 A 10/1999 Brownlee
5,988,645 A 11/1999 Downing
6,018,847 A 2/2000 Lu
6,109,614 A 8/2000 Ciarcia
6,223,029 B1 4/2001 Stenman et al.
6,230,214 B1 5/2001 Liukkonen et al.
6,283,756 B1 9/2001 Danckwerth et al.
6,289,213 B1 9/2001 Flint et al.
6,308,062 B1 10/2001 Chien et al.
6,311,980 B1 11/2001 Sovine et al.
6,322,444 B1 11/2001 Matsui et al.
6,325,376 B1 12/2001 Elliott et al.
6,328,651 B1 12/2001 Lebensfeld et al.
6,332,243 B1 12/2001 Kim
6,378,870 B1 4/2002 Sovine
6,398,215 B1 6/2002 Carroll
6,463,299 B1 10/2002 Macor
6,478,301 B1 11/2002 Witmeyer
6,484,990 B1 11/2002 Marshall
6,502,820 B2 1/2003 Slifko
6,533,280 B1 3/2003 Sovine et al.
6,543,778 B2 4/2003 Baker
6,575,753 B2 6/2003 Rosa et al.
6,588,759 B1 7/2003 Bateman
6,629,695 B2 * 10/2003 Tisdell ..... 273/359
6,679,795 B2 1/2004 Ouimette et al.
6,718,596 B2 4/2004 Kohlstrand et al.
6,728,546 B1 4/2004 Peterson et al.
RE38,540 E 6/2004 Bateman
6,761,357 B2 7/2004 Witt
6,776,418 B1 8/2004 Sovine et al.
6,808,177 B2 10/2004 Dehart

(56) References Cited

U.S. PATENT DOCUMENTS

| | | | | |
|---|---|---|---|---|
| 6,808,178 | B1 | 10/2004 | Sovine | |
| 6,896,267 | B1 | 5/2005 | Le Anna | |
| 6,975,859 | B1 | 12/2005 | Lambert et al. | |
| 6,994,347 | B2 | 2/2006 | Tessel et al. | |
| 6,994,348 | B2 | 2/2006 | Lambert et al. | |
| 6,994,349 | B2 | 2/2006 | Lambert et al. | |
| 7,134,977 | B2 | 11/2006 | Campbell et al. | |
| 7,140,615 | B1 | 11/2006 | Sovine et al. | |
| 7,175,181 | B1 | 2/2007 | Bateman et al. | |
| 7,194,944 | B2 | 3/2007 | Lambert et al. | |
| 7,201,376 | B2 | 4/2007 | Kuosa | |
| 7,219,897 | B2 | 5/2007 | Sovine et al. | |
| 7,234,890 | B1 | 6/2007 | Marshall et al. | |
| 7,264,246 | B2 | 9/2007 | Sovine et al. | |
| 7,275,748 | B2 | 10/2007 | Lambert et al. | |
| 7,303,192 | B2 | 12/2007 | Marshall et al. | |
| 7,306,230 | B2 | 12/2007 | Lambert et al. | |
| 7,322,771 | B1 | 1/2008 | Marshall et al. | |
| 7,427,069 | B2 | 9/2008 | Bateman et al. | |
| 7,431,302 | B2 | 10/2008 | Bassett et al. | |
| 7,469,903 | B2 | 12/2008 | Marshall et al. | |
| 7,503,250 | B2 | 3/2009 | Lambert et al. | |
| 7,556,268 | B2 | 7/2009 | Bateman et al. | |
| 7,653,979 | B2 | 2/2010 | Bateman et al. | |
| 7,775,526 | B1 | 8/2010 | Lambert et al. | |
| 7,793,937 | B2 | 9/2010 | Bateman et al. | |
| 2003/0034613 | A1* | 2/2003 | Tisdell | 273/359 |
| 2005/0022658 | A1 | 2/2005 | Bateman | |
| 2006/0234069 | A1 | 10/2006 | Sovine et al. | |
| 2006/0240388 | A1 | 10/2006 | Marshall et al. | |
| 2006/0240391 | A1 | 10/2006 | Sovine et al. | |
| 2006/0284380 | A1* | 12/2006 | Casas | 273/359 |
| 2006/0290063 | A1 | 12/2006 | Hagar | |
| 2006/0290064 | A1 | 12/2006 | Hagar | |
| 2007/0072537 | A1 | 3/2007 | Bateman et al. | |
| 2007/0102883 | A1 | 5/2007 | Parks et al. | |
| 2011/0031695 | A1* | 2/2011 | Gibson | 273/359 |

OTHER PUBLICATIONS

Duelatron, Product Literature 1995.
Law Enforcement Targets, Inc., Product Literature, Jul. 8, 2003.
Law Enforcement Targets, Inc., Product Literature, Oct. 12, 2004.
Law Enforcement Targets, Inc., Product Literature, June 26, 2007.
Metal Spinning Target, Inc., Dueling Trees, Jul. 8, 2003.
Mike Gibson Manufacturing, Dueling Tree, Jul. 8, 2003.
Outwest Mfg. Products, Product Literature, Jul. 8, 2003.
Porta Target, Product Literature, Circa 2000.
Shootrite, Tactical Training Target, published prior to Apr. 4, 2005.

* cited by examiner

EMERGENCY STOPPING SYSTEM FOR TRACK MOUNTED MOVABLE BULLET TARGETS AND TARGET TROLLEYS

PRIORITY

The present application claims the benefit of U.S. Provisional Application Ser. No. 61/425,708, filed Dec. 21, 2010, which is herein incorporated by reference in its entirety.

THE FIELD OF THE INVENTION

The present invention relates to track mounted ballistic targets. More specifically, the present invention relates to an emergency stopping system for stopping a track mounted target and preventing the target and carrying vehicle from exiting a designated portion of a track.

BACKGROUND

In order for soldiers and the like to maintain the combat skills it is important that they regularly engage in training exercises. However, such training can also be time consuming and expensive. For example, when training for tank combat, there is considerable cost in fuel, targets, ammunition and related materials. Additionally, the soldier's time and the amount of time which they occupy a training facility are important, as there may be a large number of soldiers who need to be trained on limited facilities. Thus, it is important that targets remain in an operational state, and that if a target is damaged or otherwise becomes non-operational the target can be quickly returned to an operational state. Preventing targets from becoming non-operational and allowing them to be quickly repaired and placed back into operation is advantageous as it eliminates downtime at the training facility and reduces the operational costs of the target system. In some cases, time limits for repair and placing a target back to an operational state is part of a required performance specification for a target system.

Large targets such as tank targets may include a trolley which moves on rails and a large target mounted to the trolley. These trolleys may weigh several thousand pounds, as they carry a large target overhead, and must resist tipping over in wind storms and when moving along a track. These trolleys may travel at speeds of up to 40 miles per hour or faster to simulate a tank moving at full speed. While such tank target systems usually include brakes, there are times when the brakes either fail or are insufficient to stop the trolley prior to the end of the track.

As the heavy trolley reaches the end of the tracks, it is important that it be stopped. In the case of a brake failure or too little stopping distance, the trolley can overrun or jump off the tracks. If the trolley jumps the tracks, a heavy lifting rig must be brought in and the trolley must be placed back on the tracks. The trolley may also be damaged and must be repaired. In either case, a significant delay is possible.

In some cases, to prevent a runaway trolley, sand has been placed around the end tracks to decelerate the trolley. While this may prevent the trolley from travelling well off the end of the tracks or damage to the trolley if it hits an abutment at the end of the tracks, the sand seems to get drawn in the wheels, etc. of the trolley and can delay redeployment of the trolley. Thus, once the trolley stops in the sand, a crew should go in and clean the sand out of the trolley. Even if cleaned, some sand may remain and further damage the trolley during further exercises. Such cleaning wastes both time and manpower.

Thus there is a need for an emergency stopping mechanism for a trolley that avoids the contamination of the trolley, while keeping the trolley from running off the end of the tracks.

SUMMARY OF THE INVENTION

It is an object of the present invention to provide an improved emergency stopping system for a trolley.

According to one aspect of the invention, a guide on the trolley engages a pair of diverging cables (or a looped diverging cable). As the trolley moves forward, the guide forces the cables together and energy and speed of the trolley is dissipated. The trolley is stopped by the cables. In some cases, the cables snap. Even if the cables snap, the energy expended to snap the cable reduces the speed of the trolley so that the trolley is much easier to stop and can be more easily kept on the track.

According to another aspect of the invention, a new cable or a new set of cables may be quickly replaced along the tracks. New cables may be restrung and tightened within a relatively short period of time. Often, the cables may be repaired within a few minutes. Thus, after an emergency stopping situation, the system may be quickly reset and the trolley put back into service with the emergency stopping system reset and ready for use.

According to another aspect of the invention, the cost of resetting the system may be minimal. Cable replacement may be cheaper than cleaning or repairing a trolley or causing a heavy lifting rig to be called on site. Similarly, the cost of lost time using the target range may be significantly reduced.

According to another aspect of the invention, a trolley with active drive wheels may be stopped. The trolley may engage one or more cables angled upward, converting forward energy into upward force. The trolley may then be lifted by the cables such that the drive wheel friction on the track may be reduced until the friction is insufficient to propel the trolley forward.

These and other aspects of the present invention are realized in an emergency stopping system for a trolley as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
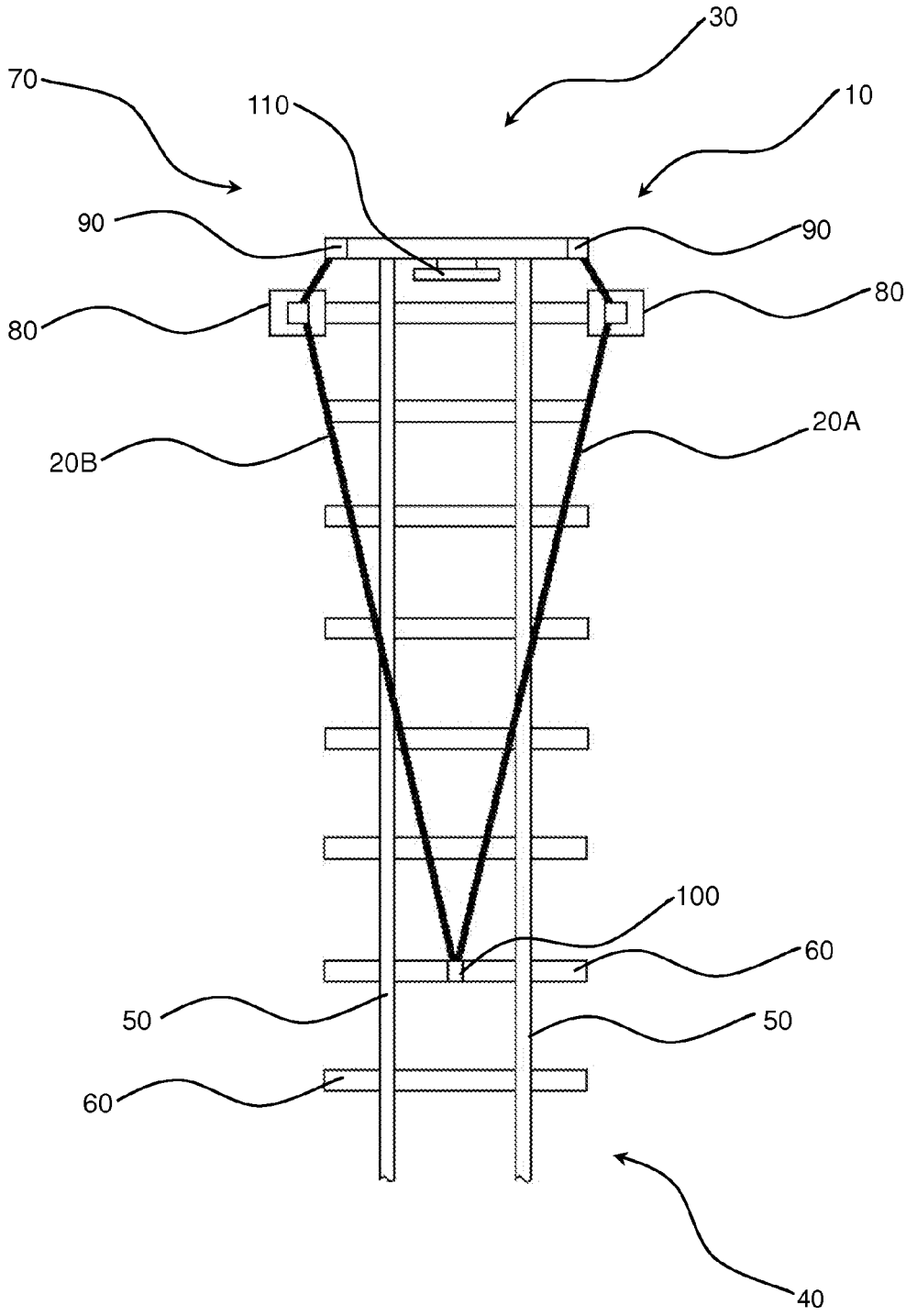
FIG. 1 shows a top view of an emergency stopping system of the present invention.
Figure 2:
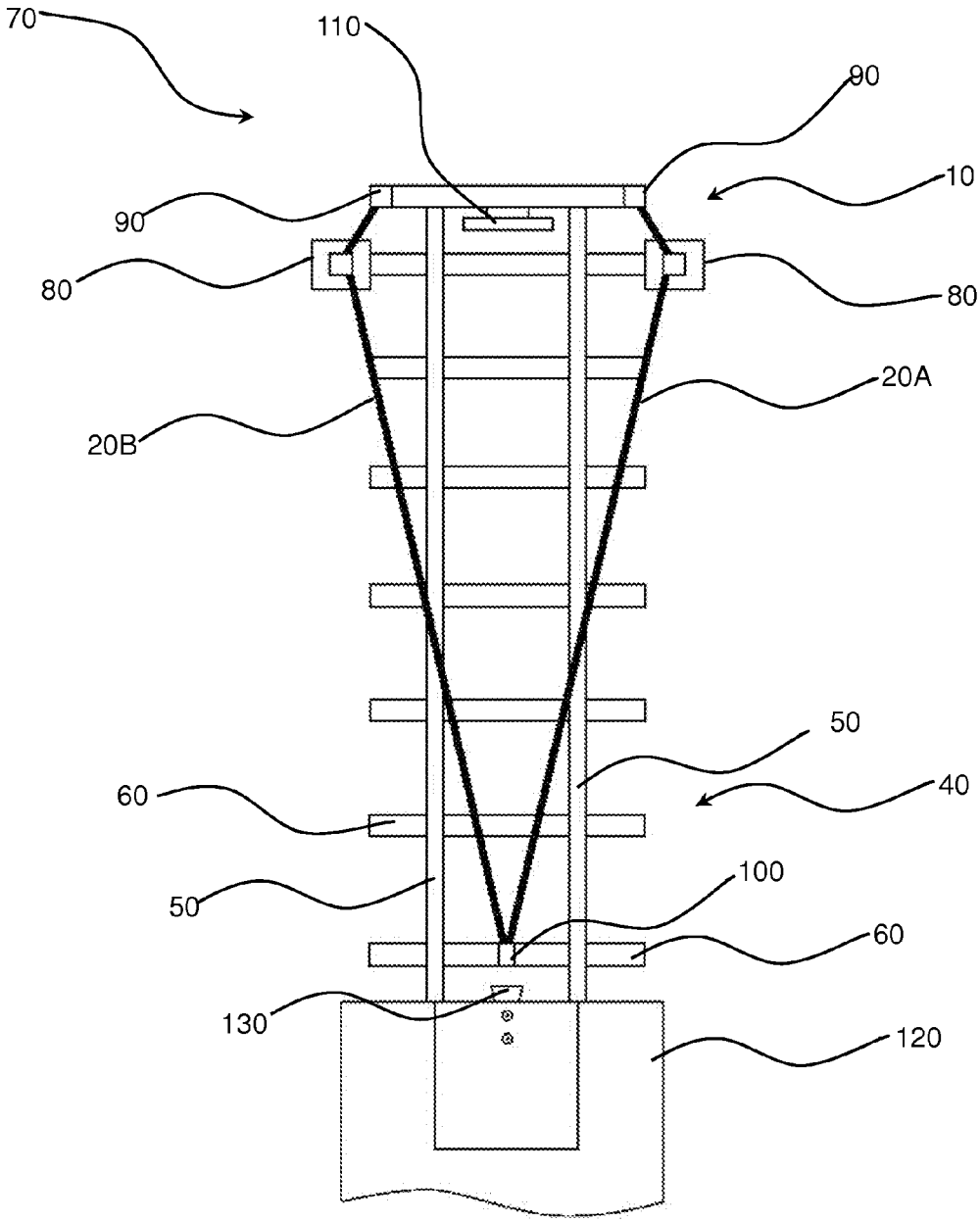
FIG. 2 shows a top view of an emergency stopping system with a trolley before engagement with the system.
Figure 3:
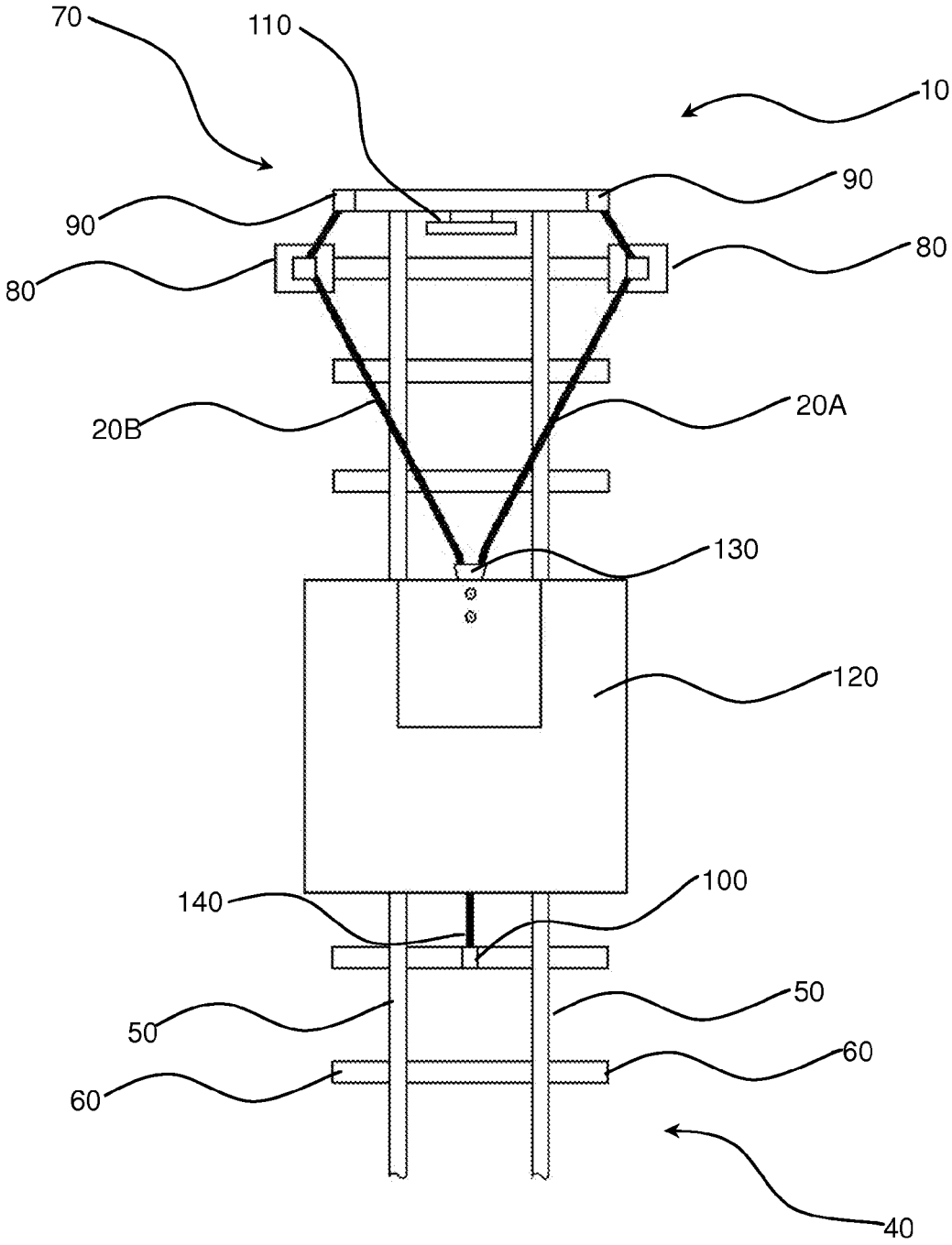
FIG. 3 shows a top view of an emergency stopping system with a trolley after engagement with the system.

In FIGS. 1 to 3, top view of an emergency stopping system, generally indicated at 10, is shown. The emergency stopping system allows a trolley 120 (FIGS. 2 and 3) to be stopped or significantly decelerated by forced engagement with two diverging cable segments 20A, 20B (sometimes simply referred to as cables). The trolley, as it slides towards the end of the track 40, engages the cable segments 20A, 20B and forces them towards each other. By forcing the cables together, a significant amount of kinetic energy may be dissipated in friction as well as through the forced stretching of the cable segments. The cable segments may diverge from an imaginary central line 30 along the track 40. As discussed herein, the cable segments may be two portions of a single cable or two separate cables. Likewise, a plurality of cables could be used to form opposing cable segments.

Turning now specifically to FIG. 1, a top view of an emergency stopping system 10 is shown. The system may be placed adjacent the end of a track, generally indicated at 40, which may have rails 50 and ties 60. A pair of cable segments 20A, 20B may be placed such that they are spaced apart near the end of the track, generally indicated at 70, and converge towards each other near a point farther away from the end of the track. The cables may be supported by posts 80 to space the cables upwardly away from the track.

In one embodiment, cable segments are supported by the reinforced posts or anchors 80 and attached to a location adjacent to the end of the track at tie downs or cable end mounts 90. This may allow the reinforced posts 80 to carry forces directed inwardly toward the track, while leaving the forces along the direction of the track to be concentrated at the tie downs 90. Away from the end of the track 70, the cable segments 20A, 20B may converge at a central tie down 100 or anchor, or a plurality of tie downs disposed adjacent one another. The cable segments 20A, 20B are often attached adjacent a central anchor point 100 which is located along the track away from the end of the track 70 and the support posts 80.

Often, the center anchor point 100 is located between 10 and 60 feet away from the track. Where heavy target trolleys are used, the center anchor point 100 is often located about 50 feet away from the end of the track 70 and from the cable end mounts 90. The track rails 50 are often about 3 feet apart. An acute angle is thus formed between the cable segments 20A, 20B. This angle may often be between 2 and 20 degrees. Where heavy target trolleys are used, the angle between the cable segments 20A, 20B is often about 3.5 degrees. According to one embodiment, the center cable mount 100 is located to hold the associated end of the cable segments 20A, 20B about 4 inches below the surface of the track rails 50 and the cable end mounts 90 or support posts 80 are positioned to hold the cable segments about 8 inches above the top of the track rails 50. Thus, for a heavy target trolley, the cable segments 20A, 20B are about 50 feet long and raise up about 1 foot between the center cable mount 100 and the cable end mounts 90 or support posts 80. This particular configuration of having long cables disposed at a narrow included angle relative to each other and disposed at a gradual incline relative to the track has been found effective in stopping heavy target trolleys without damage to the trolley or the track.

In addition to cable segments 20A, 20B, there may be a bumper 110 at or near the end of the track 40. Bumpers 110 are reasonably effective at slow speeds, for example below 10 miles per hour and more preferably below 5 miles per hour. However, if the trolley is traveling at a much higher velocity, the trolley, the bumper or both may be damaged on impact. This causes much more damage and requires more time to repair. Thus, it is highly desirable to substantially reduce the velocity of the trolley prior to any impact with the bumper 110.

Turning now to FIGS. 2 and 3, a top view of the emergency stopping system 10 with a trolley 120 before and after engagement with the system 10 is shown. In FIG. 2, a trolley 120 with a cable engagement member or guide member 130 approaches the emergency stopping system 10. The engagement member or guide 130 may be placed at a slightly elevated height relative to the central tie down 100, such that the engagement member 130 may pass over the central tie down 100 and engage the cables 20A, 20B with sidewalls 190 (FIG. 7) which extend downwardly from the trolley 120. The cables 20A 20B, tie downs 90, central tie down 100 and engagement member 130 may be placed such that the cables 20A, 20B have a central passage available under the trolley 120.

The cable engagement member 130 may be formed to resemble an inverted "U" shape, defining a slot formed between an upper surface and two downwardly extending side walls. The cable segments 20A, 20B are channeled between the sidewalls and into the "U" shape to stop a trolley. More preferably, the downwardly extending sidewalls may taper inwardly somewhat as is shown in FIG. 7, so that the cable engaging slot defined by the engagement member is narrower at the open bottom of the slot and wider at the enclosed top of the slot. This shape keeps the cable segments captive in the slot and reduces the likelihood that the cable segments jump out of the slot when a trolley is being stopped by the cable segments. The cable engagement member 130 may be positioned so that the central cable anchor 100 passes through the slot and between the sidewalls, allowing the cable engagement member to pass over the cable anchor 100 and engage the cable segments 20A, 20B.

In FIG. 3, the engagement member 130 engages the cables 20A 20B and forces the cables together, as indicated at 140, as the trolley 120 moves toward the end of the track 40. The further the engagement member 130 advances along the cables, the more force is applied to draw the cables toward one another. A significant amount of energy is dissipated in friction and in bending or stretching the cables. In forcing the cables together, the cables 20A, 20B may be significantly stretched and eventually break. The stretching and/or breaking of the cables 20A, 20B dissipates the kinetic energy of the trolley 120, reducing its velocity. Depending on the initial speed of the trolley 120, the trolley 120 may be stopped while engaging the cables 20A 20B or, in the case of cable breakage, by the bumper 110. Trolleys moving at a low speed may be stopped by the cables without breaking the cables. Trolleys moving faster may break the cables and stop against the bumper. This is advantageous as the cables dissipate sufficient energy that the trolley may be stopped by the bumper without breaking the bumper or the trolley.

Many training procedures are conducted with trolleys which move quickly and which are self-powered. Occasionally, these trolleys will not stop at a designated location due to brake failure or a control malfunction. These trolleys require a significant amount of work to stop the trolley and prevent damage to the trolley or track. While the present system uses disposable cables, it prevents damage to the trolley and track. The cables are significantly less expensive and can be replaced much more quickly than repairing a trolley or track or placing a trolley back onto the track after such a problem.

The system 10 may gradually increase the dissipation of kinetic energy. Near the central tie down(s) 100, the resistance of the cable segments 20A, 20B to being pushed together is smaller than near the reinforced posts 80. As the trolley 120 passes closer to the reinforced posts 80, more kinetic energy is dissipated in forcing the cables together 140. Thus a trolley 120 with a slow speed entering the emergency stopping system 10 may be more gently stopped than a trolley 120 with a greater speed. Either way, however, increasing resistance is applied to stop the trolley so as to provide a gradual deceleration as compared to simply impacting the bumper. This lowers the initial deceleration force and gradually increases the force and as such lessens the likelihood of damage to either the trolley 120 or the bumper 110 and also reduces the risk of damage to the target on the trolley.

The stopping forces which the emergency stopping system 10 applies to the trolley 120 may be adjusted by adjusting the width between the reinforced posts 80 and the distance between the reinforced posts 80 and the central tie down 100. A longer distance between the support posts 80 and the central attachment point 100 will stop a trolley more gradually. The stopping forces of the emergency stopping system may also be adjusted by selecting the cables 20A 20B composition, type, braid, strength, stretching ability and other cable attributes. For example, a thicker cable made of a less stretchable material will tend to stop the trolley more abruptly or break, than will a thinner, more stretchable cable. While it is currently anticipated using ¼ inch to ½ inch steel cables, those skilled in the art will appreciate that a variety of different sizes and materials may be used.

Figure 4:
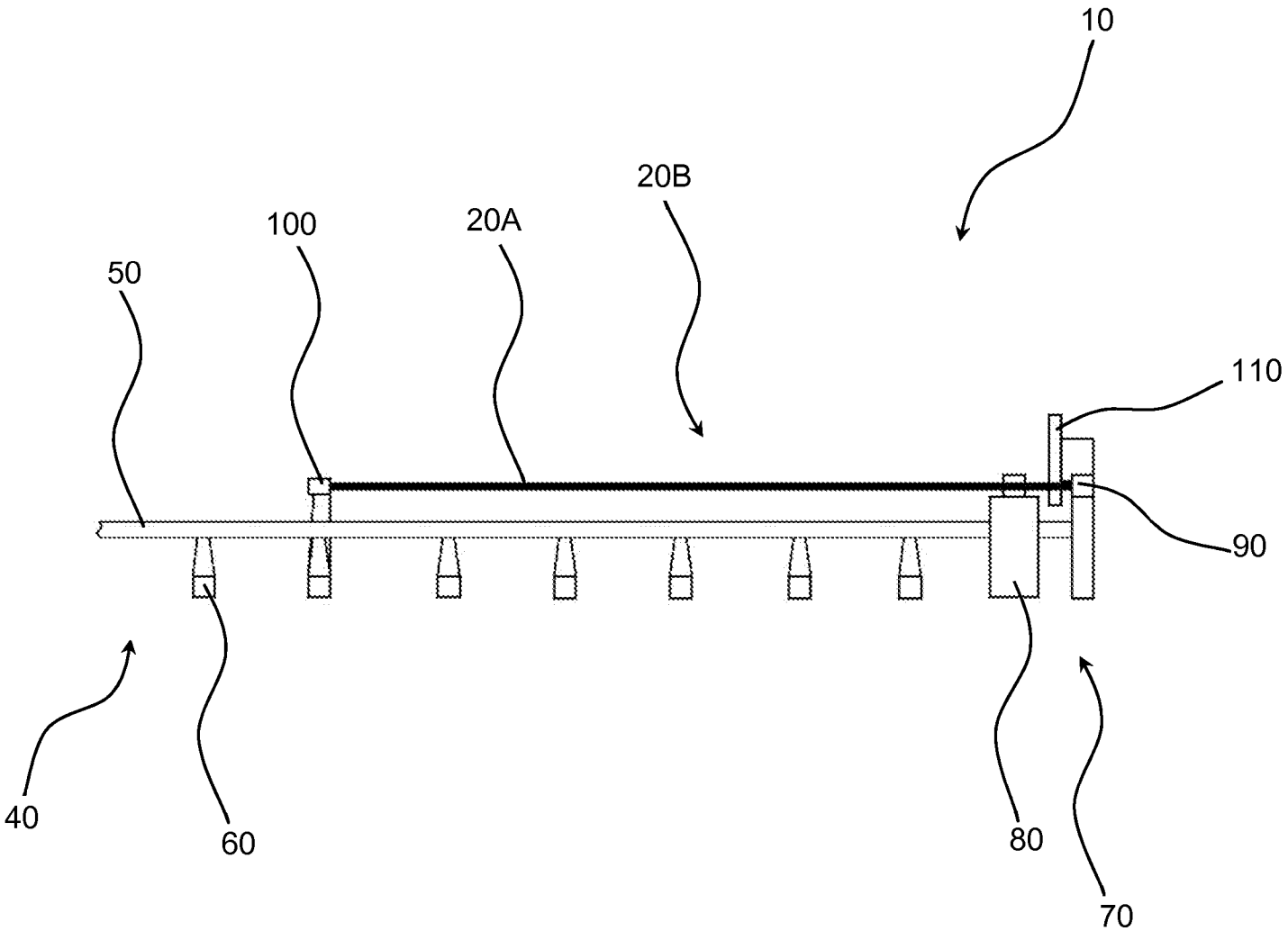
FIG. 4 shows a side view of an emergency stopping system of the present invention.

Turning now to FIG. 4, a side view of an emergency stopping system 10 is shown. The emergency stopping system may include the rails 50 and ties 60 of a track which carries the target trolley, cables 20A 20B, tie downs 90, central tie down 100, and reinforced posts 80. It can be seen how the central cable mounting location 100 and the support posts 80 elevate the cables 20A, 20B above the track rails 50. This allows the trolley mounted engagement member 130 to more easily and more reliably engage the cables 20A, 20B.

Figure 5:
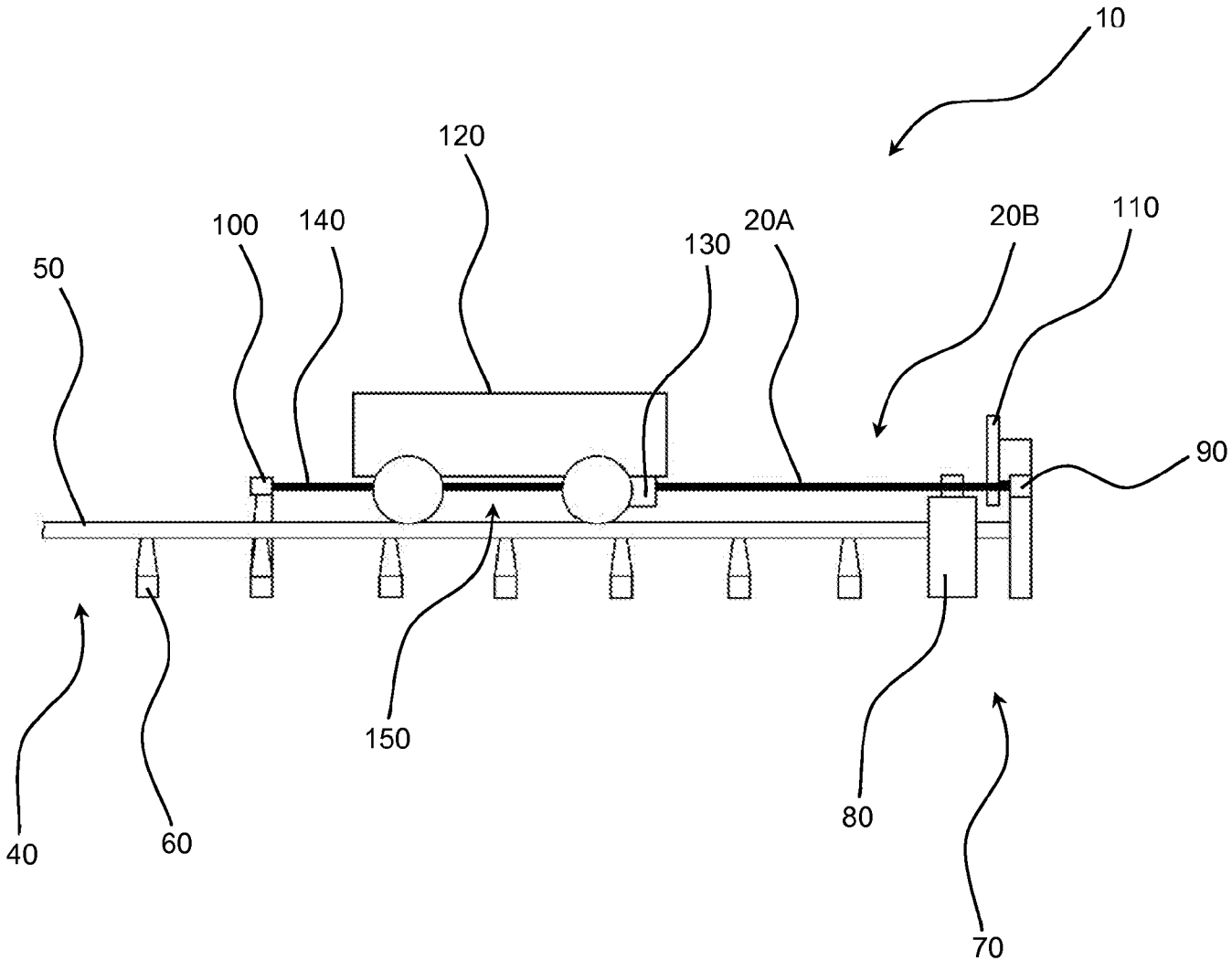
FIG. 5 shows a side view of an emergency stopping system with a trolley after engagement with the system.

Turning now to FIG. 5, a side view of an emergency stopping system 10 with a trolley 120 after engagement with the system 10 is shown. The trolley 120 includes an engagement member 130 disposed at about the height of the cables 20A 20B so that the cables are captured in the channel formed in the engagement member (as shown in FIG. 7). The trolley underside 150 is configured to allow the center mount 100 and the cables 20A, 20B to pass underneath the trolley.

Figure 6:
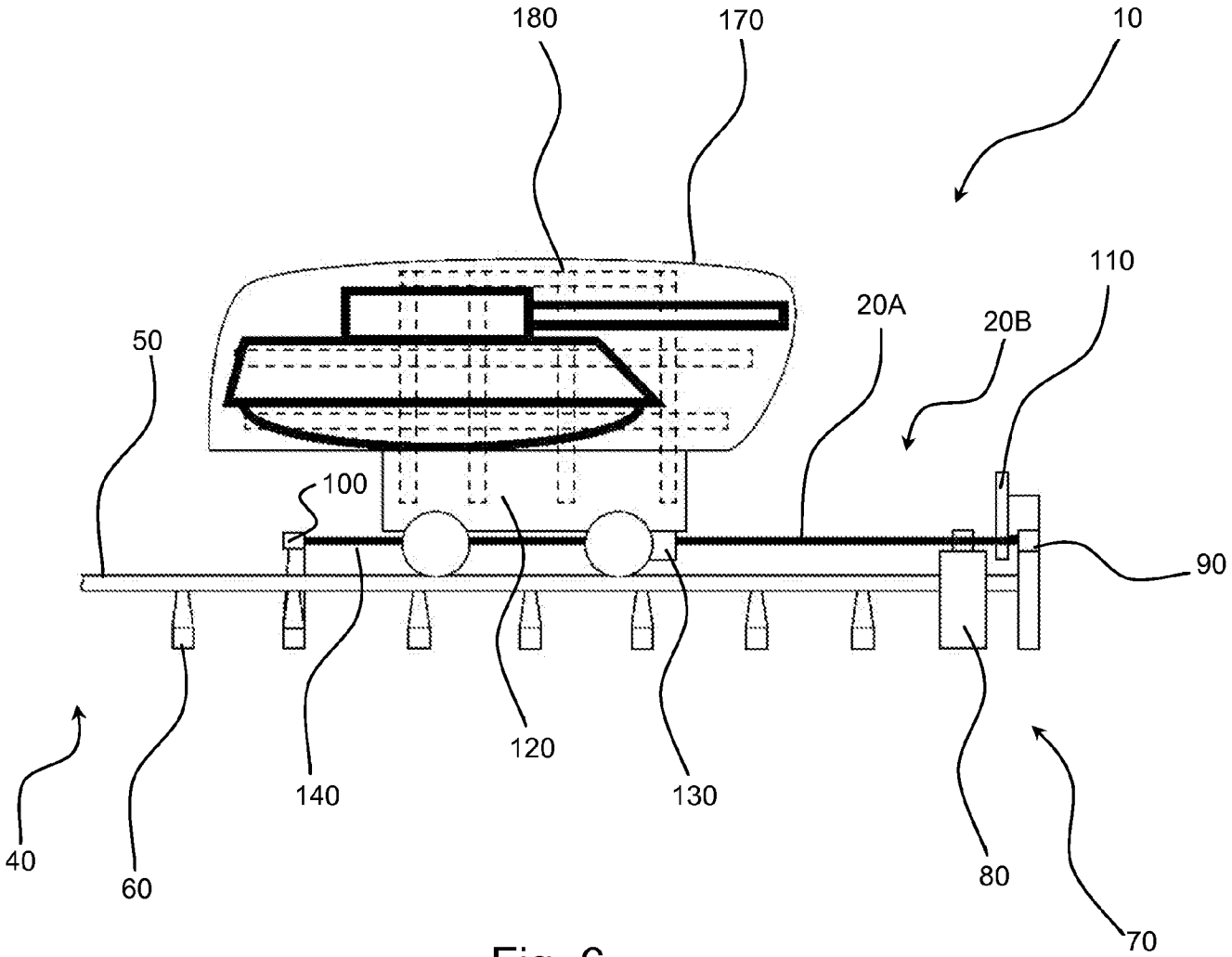
FIG. 6 shows a side view of an emergency stopping system with a tank target trolley after engagement with the system.

Turning now to FIG. 6, a side view of an emergency stopping system 10 is shown. The trolley 120 is shown after engagement with the cables 20A, 20B. The trolley 120 is shown with a tank target 170 attached thereto. Commonly, a support structure 180 is used to support the target 170. Although the target 170 is not shown in all figures, the other figures are understood to include such a target. The target is used to simulate large vehicles and objects for ballistic training. The targets 170 are commonly used for target practice with larger weapons which are capable of attacking a tank. Thus, the targets 170 and trolleys 120 carry significant weight and momentum. The trolley 120 and target 170 are shown after passing over the center cable mount 100 due to an uncontrolled stop. The target mounted engagement member 130 has passed over the center mount 100 and has engaged the cables 20A, 20B. As such, the engagement member 130 is pinching the cables 20A, 20B together, resulting in friction and dissipating the trolley energy. By reducing the kinetic energy of the trolley 120 gradually, the trolley 120 may be kept on the track 50 in situations where other stopping methods may have caused the trolley to jump the track, tip over or cartwheel over. By keeping on the track 50, a call to a heavy lifter may be avoided which may result in delay.

Figure 7A:
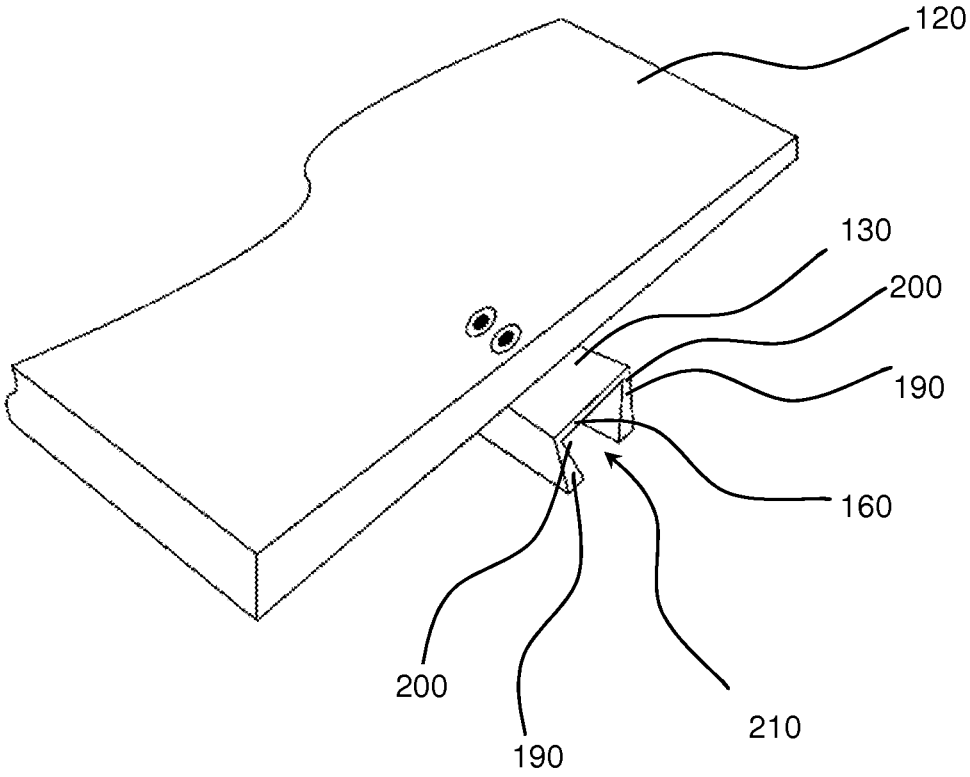
FIG. 7A shows a perspective view of a cable engagement member or guide of a trolley.

Turning now to FIG. 7A, a perspective view of the cable engagement member 130 is shown. The cable engagement member 130 is generally shaped as an upside down "U" shaped channel, having sidewalls 190 extending downwardly from an upper surface 160. The sidewalls 190 may be bent inwardly or otherwise formed so that they are closer to each other at the bottom of the channel than at the top of the channel. This causes the cables to engage the channel near the upper surface 160 due to the tension in the cables. The cables thus engage the channel in or near the corners 200 of the engagement member 130. Thus, the cables 20A 20B may be reliably contained within the engagement member 130 while leaving the bottom of the channel open to pass over the center mount 100 and thereby engage the cables. The engagement member 130 also aids in centering the trolley over the cables 20A 20B which may reduce the risk of slipping off the cables 20A 20B. The engagement member 130 also encourages the trolley to stay on the track 50. Thus the risk of a trolley 120 derailing may be further reduced.

Figure 7B:
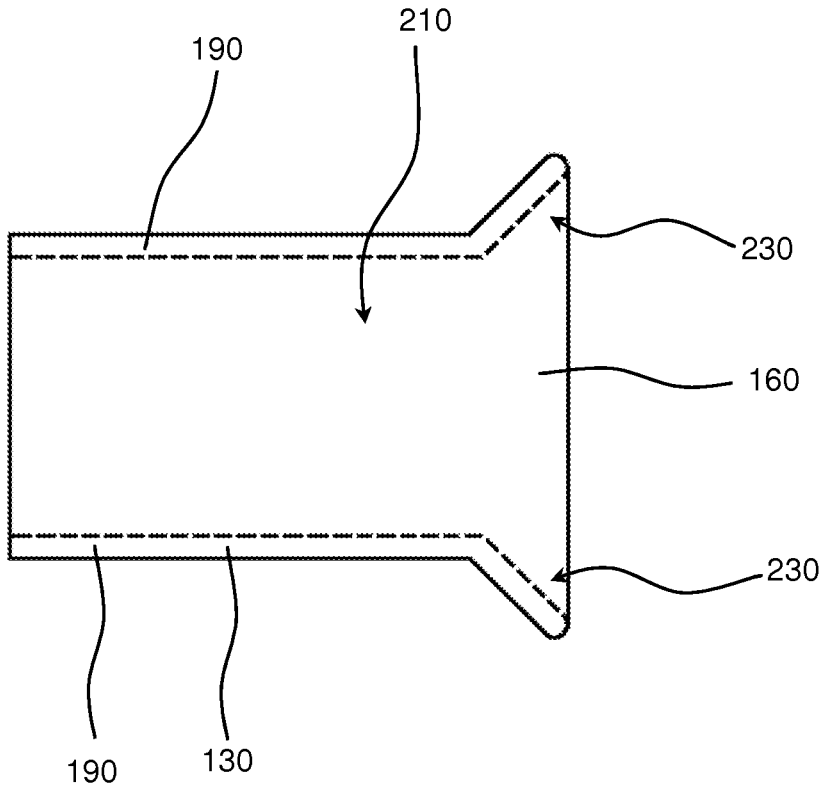
FIG. 7B shows a side view of a cable engagement member of the present invention.
Figure 7C:
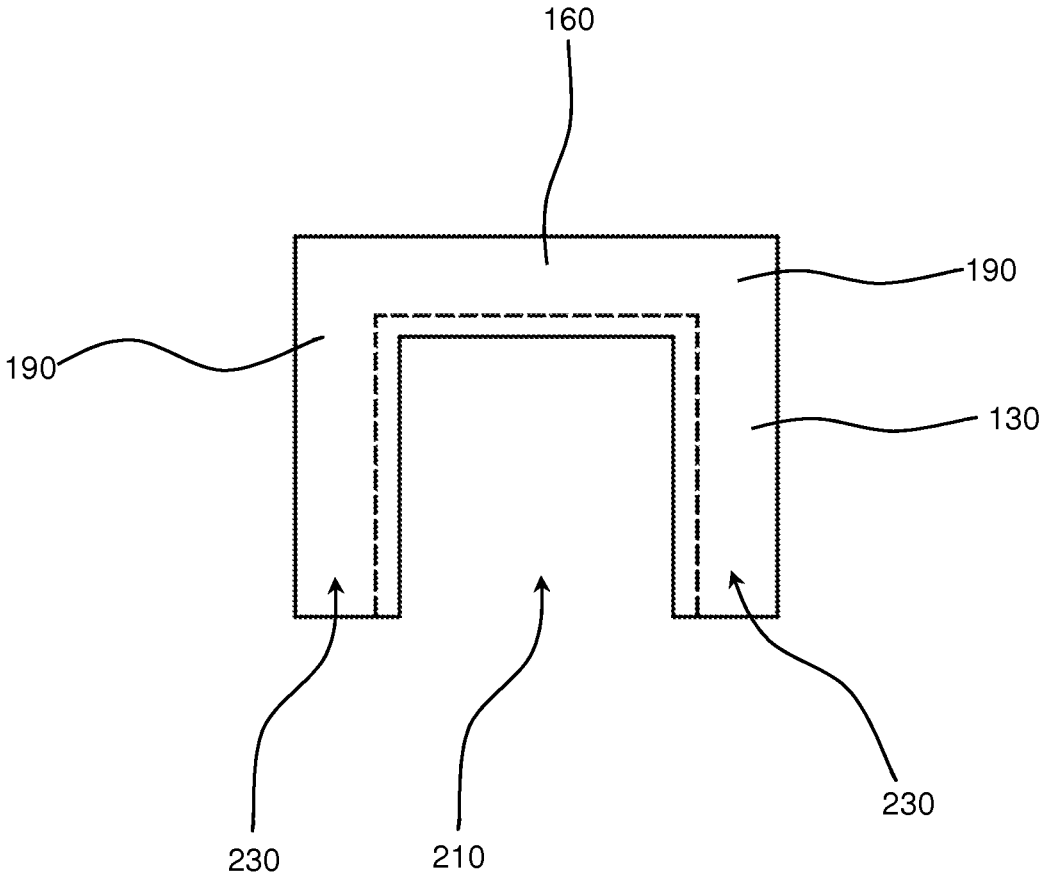
FIG. 7C shows a top view of the cable engagement member of FIG. 7B.

Turning now to FIGS. 7B and 7C, top and end views of another cable engagement member 130 is shown. The cable engagement member 130 has an upper surface 160 and sidewalls 190 which define a square or a 'U' shaped channel 210. The channel 210 is about 4 inches wide. The sidewalls 190 flare open to about a 6 inch width at the front of the channel 210, as indicated at 230. The upper surface 160 may be similarly flared open. This creates a channel front opening which is larger in size than the channel itself and also creates angled walls leading into the channel 210. This helps to guide the cable segments 20A, 20B into the channel and can also provide a more gentle forward edge for contacting the cable segments to reduce the damage to the cable segments.

Figure 8:
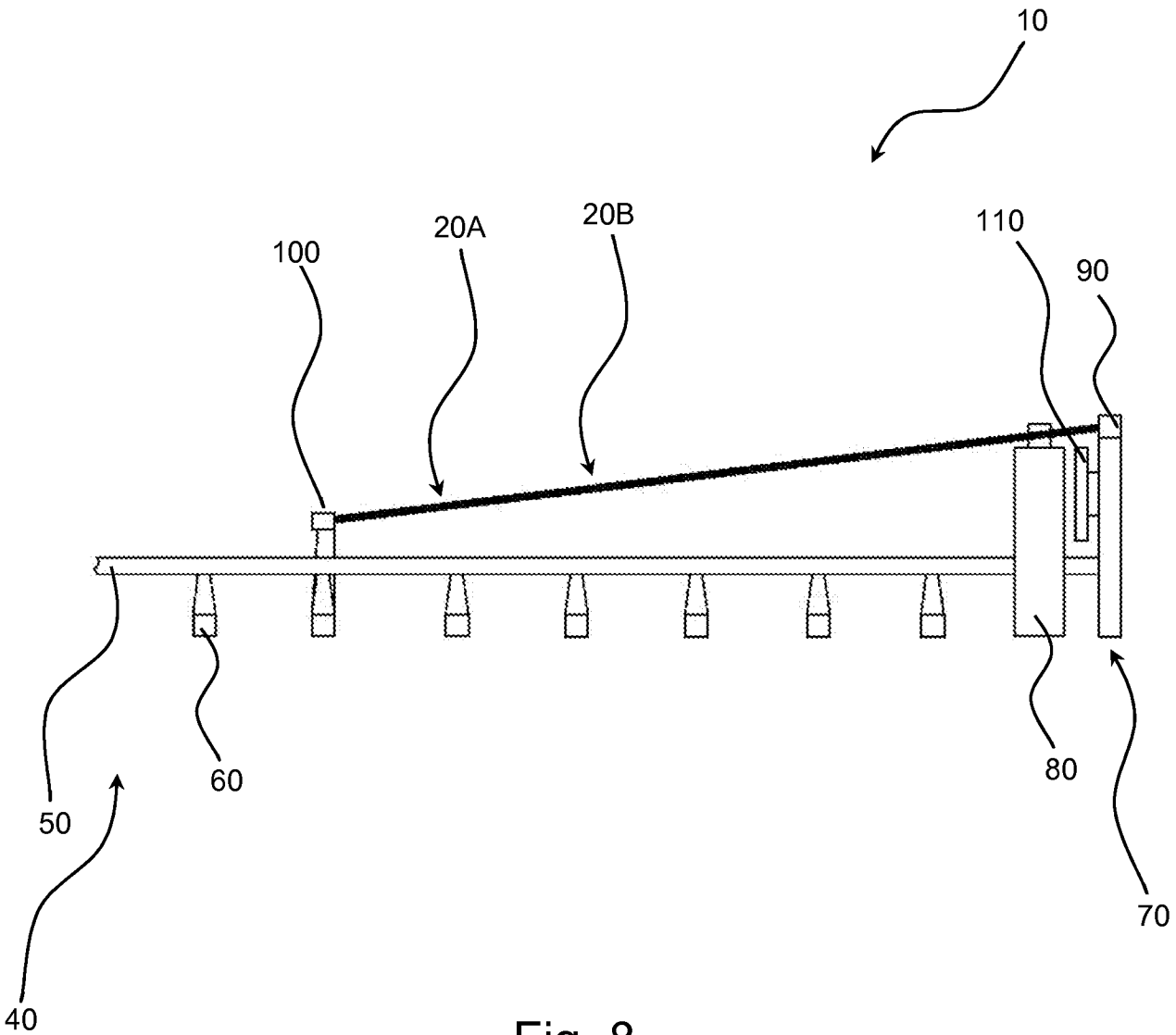
FIG. 8 shows a side view of an angled emergency stopping system of the present invention.
Figure 9:
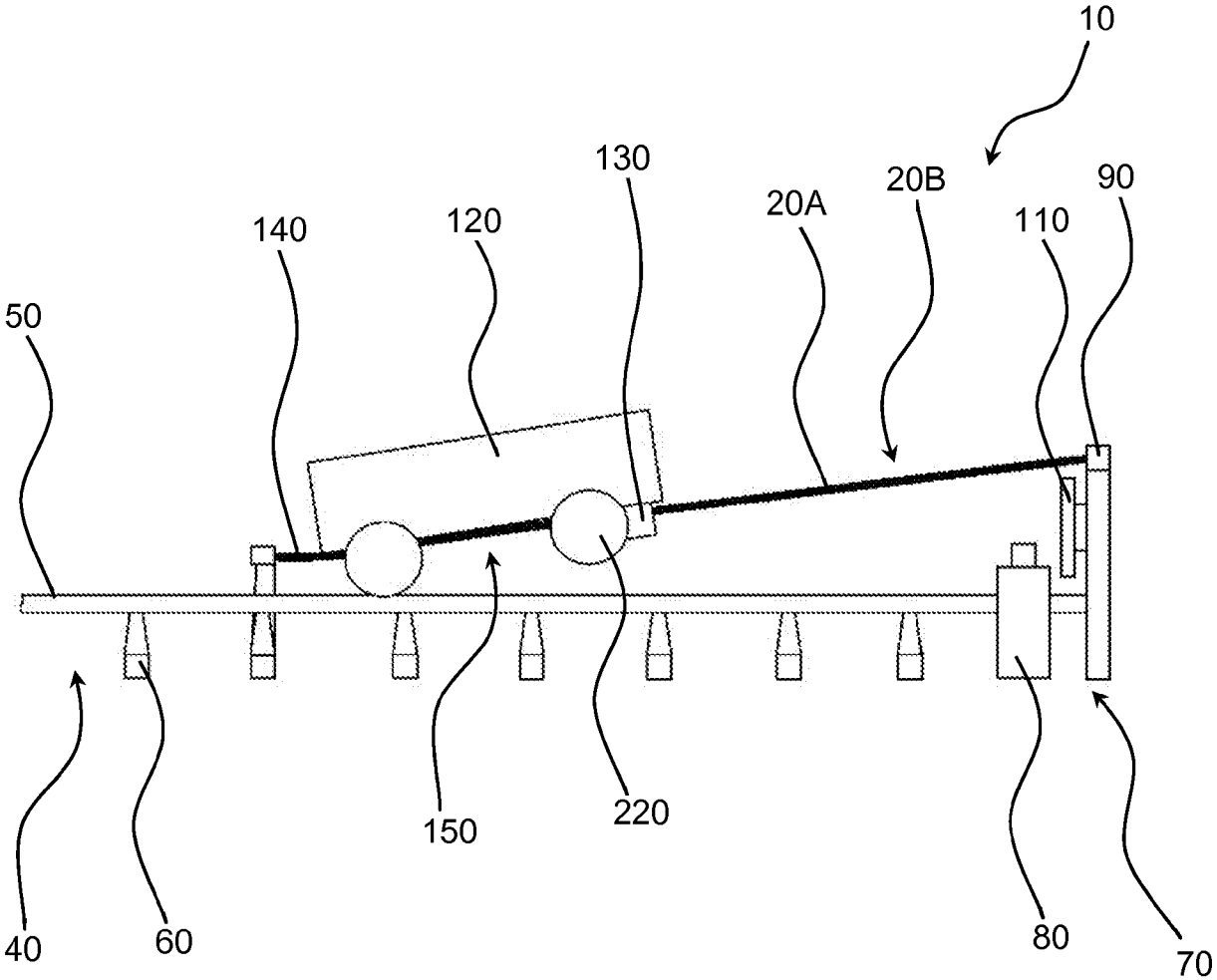
FIG. 9 shows a side view of an angled emergency stopping system with a trolley.

Turning now to FIGS. 8 and 9 another embodiment of the emergency stopping system 10 is shown. In some cases, the trolley 120 may fail such that powered drive wheels 220 are locked on. Thus, it may be necessary to reduce the friction between the drive wheels 220 and the track 50 in order to stop the trolley 120. This may be separate from or in conjunction with stopping a significant amount of forwards momentum as discussed above.

The cables 20A, 20B are positioned with an upward angle. This may be accomplished by elevating the support posts 80 and the cable end anchors 90 while leaving the center mount 100 close to the track. The upward angle causes the trolley 120 to lift off of the track as it slows down, removing the drive wheels from contact with the track or reducing the drive force of the drive wheels to the point where they no longer are capable of pushing the trolley 120 forwards. The upward force on the trolley 120 exerted by the cables 20A, 20B may cause the trolley 120 to be lifted from the tracks starting with the closest wheels. If the closest wheels are the drive wheels, this alone may be sufficient to slow the trolley to a stop. If the drive wheels are still pushing the trolling forward, it may take until both sets of wheels have been lifted off the track before the trolley slows sufficiently. Even if the drive wheels are not completely lifted off of the track, any further forward movement of the trolley 120 will further reduce the weight of the trolley on the track and reduce the friction between the wheels and the track until the drive wheels are no longer able to push the trolley.

In FIG. 9, the trolley 120 is also shown. When a trolley 120 encounters the angled cables 20A, 20B, some of the trolley's momentum will be converted into lifting the trolley as well as being dissipated into friction and stretching the cables down and together. Where the trolley 120 has powered drive wheels 220, the trolley 120 may eventually stop when the drive wheels 220 lack enough friction on the track 50 to further move the trolley 120. In some cases, the drive wheels 220 of the trolley may be lifted off of the track as shown in FIG. 9. In other cases, the drive wheels 220 may remain in contact with the track but lack sufficient friction to move the trolley. Thus, a trolley 120 may be stopped, even where the trolley has powered drive wheels 220 which will not stop and continue to try to move the trolley off of the track.

Figure 10:
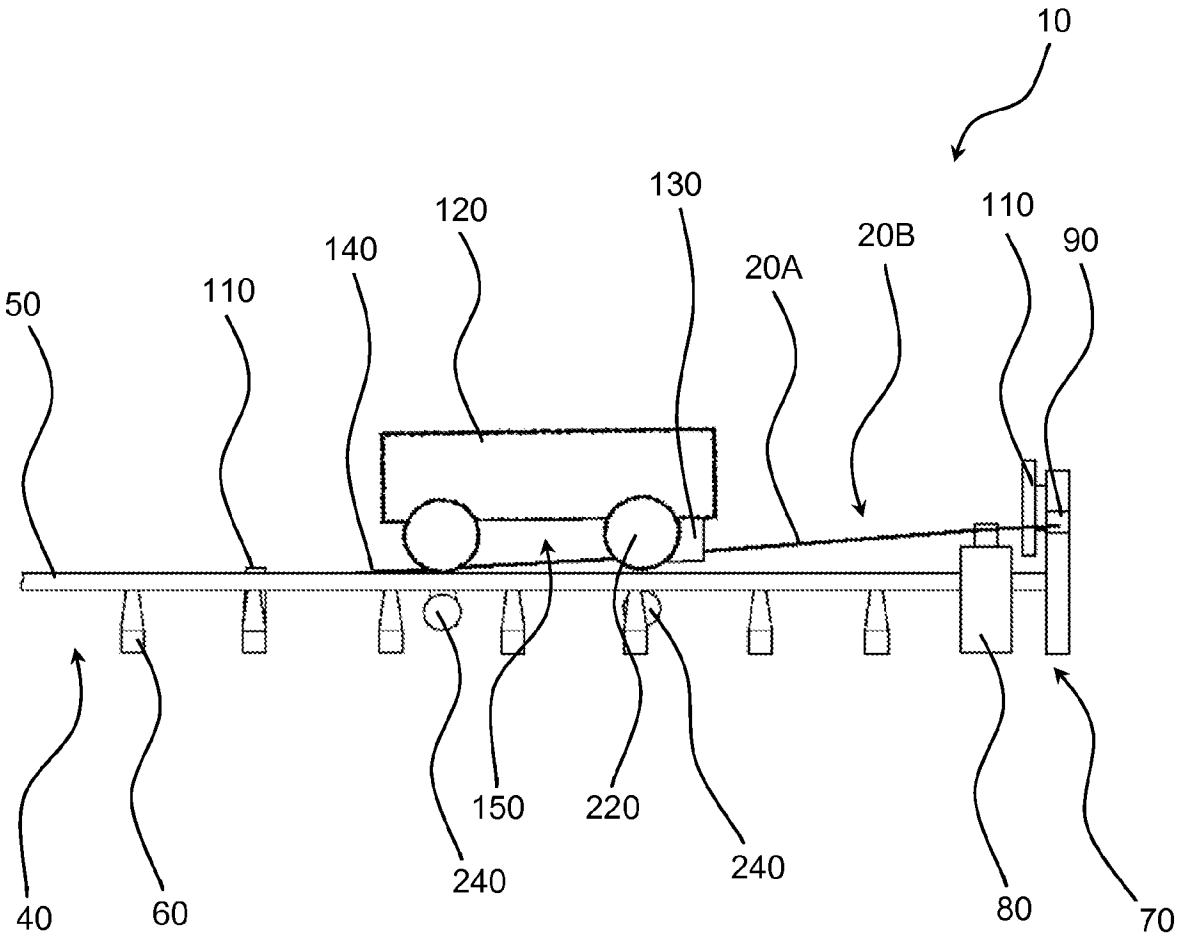
FIG. 10 shows a side view of an angled emergency stopping system with a trolley.

FIG. 10 shows an embodiment similar to FIG. 9 and similar to the previous figures. For clarity, not all structures in FIG. 10 have been labeled with a reference number or discussed explicitly. The device of FIG. 10 includes all of the previous structures and details even where not specifically discussed except where explicitly stated to the contrary. FIG. 10 shows a stopping system 10 which slopes upwardly similar to FIG. 9. The cables 20A, 20B are attached at a center cable mount 100. The center cable mount 100 is near the level of the track, and may be positioned such that the ends of the cables 20A, 20B adjacent the center mount are positioned about 4 inches below the top surface of the track rails 50 as shown. The other ends of the cables 20A, 20B are positioned higher by the end mounts 90 and support posts 80, causing the cables 20A, 20B to slope upwardly away from the surface of the track rails 50 when moving towards the end of the track 70. The cable engagement member 130 engages the cables as previously discussed.

The target trolley 120 also has lower retaining wheels 240 which are attached to the trolley and positioned below the track rails 50. These lower retaining wheels 240 may be positioned such that there is a small gap of an inch or two inches between the lower wheels 240 and the track rails 50. During normal operation, the lower retaining wheels 240 prevent the trolley 120 from tipping over as they engage the bottom of the track rails 50 if the trolley begins to tip over. When the target trolley 120 passes over the venter cable mount 100, the cable engagement member 130 engages the cables 20A, 20B as has been discussed. Since the cables 20A, 20B slope upwardly towards the end of the track 70, the front end of the trolley 120 may be lifted off of the track slightly as is shown. This can be advantageous in stopping the trolley where the front wheels are powered and are malfunctioning; continuing to drive the trolley towards the end of the track. The lower retaining wheels 240 will engage the track rails 50 and only allow the end of the target trolley 120 to lift up an inch or two. Continued forward motion of the trolley towards the end of the track 70 will increase the tension in the cables as the cables are pushed downwardly towards the track in addition to being pushed inwardly towards each other by the cable engagement member 130. This increases the likelihood that the target trolley is stopped without coming off of the track.

While the system has been discussed in the sense of two diverging cables 20A 20B, more diverging cables are considered. For example, two cables may be used on each side, each cable having a slight elevation, but a similar width.

In another embodiment, an emergency stopping system may be used which has two sets of cables in series. The trolley may engage a first emergency stopping system. If the first system does not stop the trolley within a desired distance, the trolley may then engage a second emergency stopping system. In such a configuration, a first set of diverging cables 20A, 20B may be attached to a track as discussed above. A second set of cables 20A, 20B may be attached to the track as discussed above, but displaced several feet further towards the end of the track relative to the first set of cables. If the trolley 120 is not completely stopped by the first set of cables (typically when these cables break), the trolley will then engage the second set of cables with significantly reduced speed and will be more easily stopped by the second set of cables. This may be useful where a trolley is quite large or heavy. Using two sets of cable stopping systems allows a trolley to be stopped more gradually than when using a single cable stopping system with larger cables.

There is thus disclosed an improved emergency stopping system for a trolley. It will be appreciated that numerous changes may be made to the present invention without departing from the scope of the claims.

What is claimed is:

1. A bullet target system comprising:

a track, the track having a first rail and a second rail separated from the first rail and having a first end;

a center cable mount disposed between the first rail and the second rail and disposed along the track a distance away from the first end;

a first cable end mount located adjacent to the first rail and adjacent to the end of the track;

a second cable end mount located adjacent to the second rail and adjacent to the end of the track;

a first cable attached to the center cable mount and to the first cable end mount;

a second cable attached to the center cable mount to the second cable end mount;

a target trolley supported on the track and movable on the track, the target trolley having a ballistic target mounted thereon; and a cable engagement member attached to the target trolley; and wherein moving the target trolley towards the first end of the track past the center cable mount causes the cable engagement member to engage the first cable and the second cable and force the first and second cables together to thereby stop the target trolley.

2. The system of claim 1, wherein the first cable and second cable form an acute angle therebetween.

3. The system of claim 2, wherein said acute angle is between about 2 and 10 degrees.

4. The system of claim 1, wherein the first and second cables slope upwardly from the center cable mount to the respective first cable end mount and second cable end mount.

5. The system of claim 1, further comprising a bumper disposed adjacent the first end of the track, and wherein the trolley contacts the bumper after engagement with the first and second cables.

6. The system of claim 1, wherein the cable engagement member forms a channel extending downwardly from the target trolley.

7. The system of claim 6, wherein the cable engagement member passes over the center cable mount and engages the first cable and second cable such that the first cable and second cable are located in the channel.

8. The system of claim 6, wherein the channel has and end wall connected to two sidewalls and wherein the sidewalls are disposed at an angle such that the channel is narrower near an opening formed between the sidewalls and is wider near the end wall.

9. The system of claim 1, wherein the cables lift the target trolley off of the track as the trolley moves towards the first end of the track.

10. The system of claim 1, wherein the center cable mount is disposed about 50 feet away from the first end of the track.

11. A bullet target system comprising:

a track having a first rail and a second rail, the track terminating at a first end;

a ballistic target carried on the track so as to move along the track for ballistic training exercises;

a first cable having a first end which is mounted adjacent to the track between the first rail and the second rail and a distance away from the first end of the track and a second end mounted adjacent the first rail and adjacent the first end of the track;

a second cable having a first end which is mounted adjacent to the track between the first rail and the second rail adjacent the first end of the first cable, the second cable having a second end mounted adjacent the second rail and adjacent the first end of the track;

a cable engagement member attached to the target; and wherein the cable engagement member engages the first cable and the second cable as the target moves towards the first end of the track to thereby stop the target.

12. The system of claim 11, wherein the first cable and the second cable form an acute angle therebetween.

13. The system of claim 12, wherein the acute angle is between about 2 and 10 degrees.

14. The system of claim 11, wherein the first cable and second cable have a length which is about 15 times a distance between the track first rail and second rail.

15. The system of claim 11, wherein the first end of the first cable and the first end of the second cable are mounted to a center cable mount disposed between the first rail and the second rail and wherein the center cable mount is disposed a distance away from the first end of the track so that the first cable and the second cable are disposed at an acute angle relative to each other.

16. The system of claim 11, wherein the first end of the first cable and the first end of the second cable are mounted below the surface of the track as viewed horizontally and wherein the second end of the first cable and the second end of the second cable are mounted above the surface of the track as viewed horizontally.

17. The system of claim 11, wherein the second ends of the first and second cables are mounted higher than the first ends of the first and second cables such that the cables slope upwardly towards the first end of the track.

18. The system of claim 11, wherein the cable engagement member defines a channel extending downwardly away from the bottom of the target and wherein the cable engagement member passes over the first ends of the first and second cables and engages the first and second cables to hold the first and second cables within the channel.

19. The system of claim 17, wherein further movement of the target towards the first end of the track maintains the first and second cables in the channel and pulls the first and second cables towards each other.

20. The system of claim 11, wherein the target is mounted to a target carrying trolley, the trolley having wheels which ride on the first rail and second rail to move the target along the track.

21. The system of claim 17, wherein the target further comprises a lower retaining member extending below the track which stops the target from lifting upwardly due to contact with the first and second cables.

* * * * *